US005174216A

United States Patent [19]

Miller et al.

[11] Patent Number: 5,174,216

[45] Date of Patent: Dec. 29, 1992

[54] DIGITAL SOUND REPRODUCING SYSTEM FOR TOY TRAINS WITH STORED DIGITIZED SOUNDS RECALLED UPON TRACKSIDE TRIGGERING

[75] Inventors: Gary L. Miller, Shelby Township, Macomb County; Keith F. Green, Fraser, both of Mich.

[73] Assignee: Miller Electronics, Shelby Township, Macomb County, Mich.

[21] Appl. No.: 668,973

[22] Filed: Mar. 13, 1991

[51] Int. Cl.[5] ..... B60L 1/00; B60L 9/04

[52] U.S. Cl. ..... 104/296; 105/27; 104/DIG. 1; 246/193; 446/410

[58] Field of Search ..... 104/295, 296, 297, 300, 104/307, DIG. 1; 105/1.5, 27; 191/4; 246/193, 197, 246, 247; 446/409, 410; 340/384 E

[56] References Cited

U.S. PATENT DOCUMENTS

| | | | |
|---|---|---|---|
| 30.174 | 10/1875 | Schedle | 340/384 E |
| 1.284.977 | 11/1918 | Auerill | 191/4 X |
| 1.698.864 | 1/1929 | Wilckens | 246/193 |
| 2.882.834 | 4/1959 | Smith | 104/296 |
| 3.581.084 | 5/1971 | Kaneno et al. | 246/249 |
| 3.812.345 | 5/1974 | Stone | 246/249 |
| 3.839.822 | 10/1974 | Rexford | 446/410 |
| 3.893.107 | 7/1975 | Schedler | 340/384 E |
| 4.266.368 | 5/1981 | Nyman | 446/410 |
| 4.293.851 | 10/1981 | Beyl, Jr. | 340/384 E |
| 4.314.236 | 2/1982 | Mayer et al. | 340/384 E |
| 4.325.199 | 4/1982 | McEdwards | 446/409 X |
| 4.524.932 | 6/1985 | Bodziak | 246/249 X |
| 4.964.837 | 10/1990 | Collier | 446/409 |
| 4,995,320 | 2/1991 | Sato et al. | 104/295 X |

FOREIGN PATENT DOCUMENTS

| | | | |
|---|---|---|---|
| 820714 | 11/1937 | France | 446/410 |
| 1250496 | 8/1986 | U.S.S.R. | 246/193 |

*Primary Examiner*—Robert J. Oberleitner
*Assistant Examiner*—S. Joseph Morano
*Attorney, Agent, or Firm*—Krass & Young

[57] ABSTRACT

A digital sound reproducing system which produces a plurality of sound effects from digital data stored at predetermined addresses in a digital sound memory. A controller connected to the digital sound memory causes recall of a sound data from a predetermined sequence of addresses when triggered. This recalled sound data is converted into an analog audio signal for reproduction by a speaker. In a first embodiment the digital sound reproducing system is disposed in the car of a model train. Magnets disposed between the tracks trigger corresponding sound effects when the digital sound reproducing system detects passage of the magnets. A speed sensor detects the rotation rate of a wheel of the car to permit sound effects to be synchronous with the rate of speed of the model train. The digital sound reproducing system may alternately be disposed in a fixed structure and triggered by a command signal or by detection of passage of the model train. In a second embodiment, a detector indicates when a space may be occupied triggering a radomized sound sequence as background noise.

17 Claims; 6 Drawing Sheets

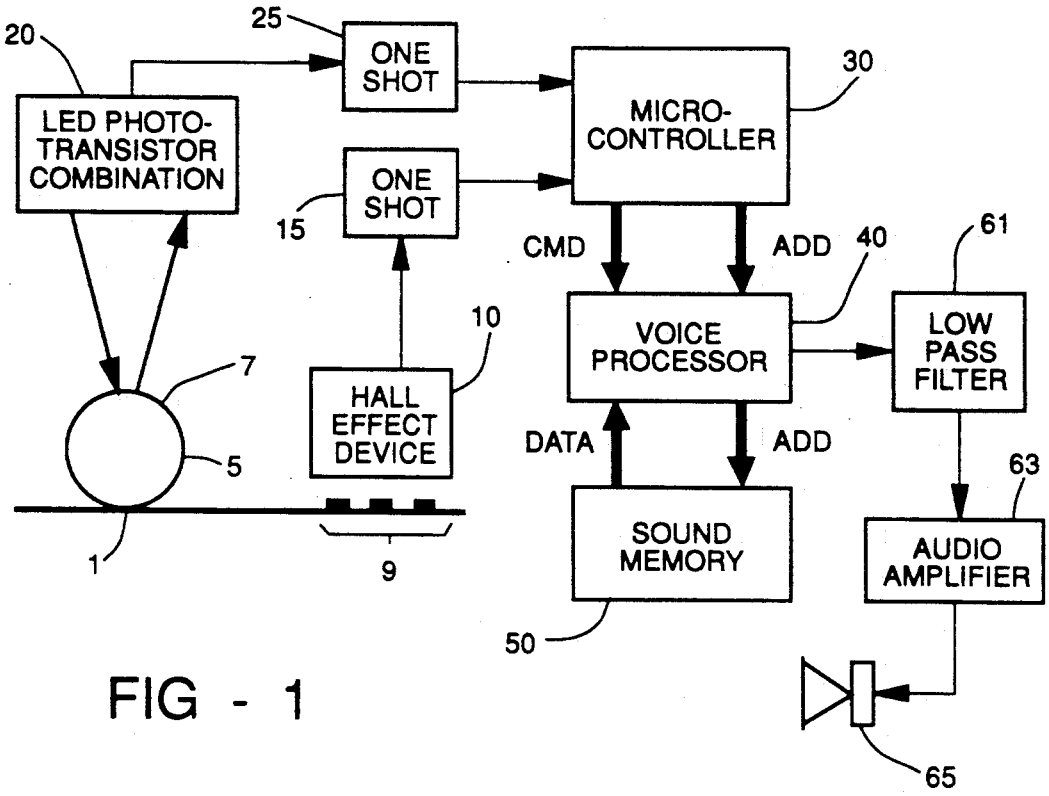
FIG - 1
FIG - 2
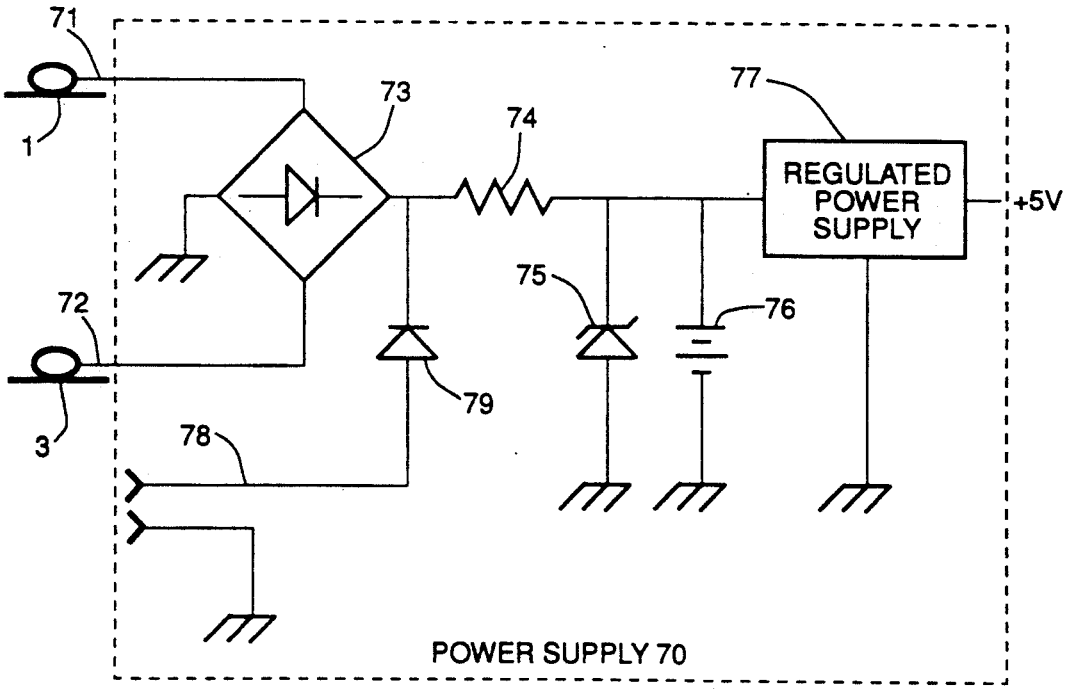

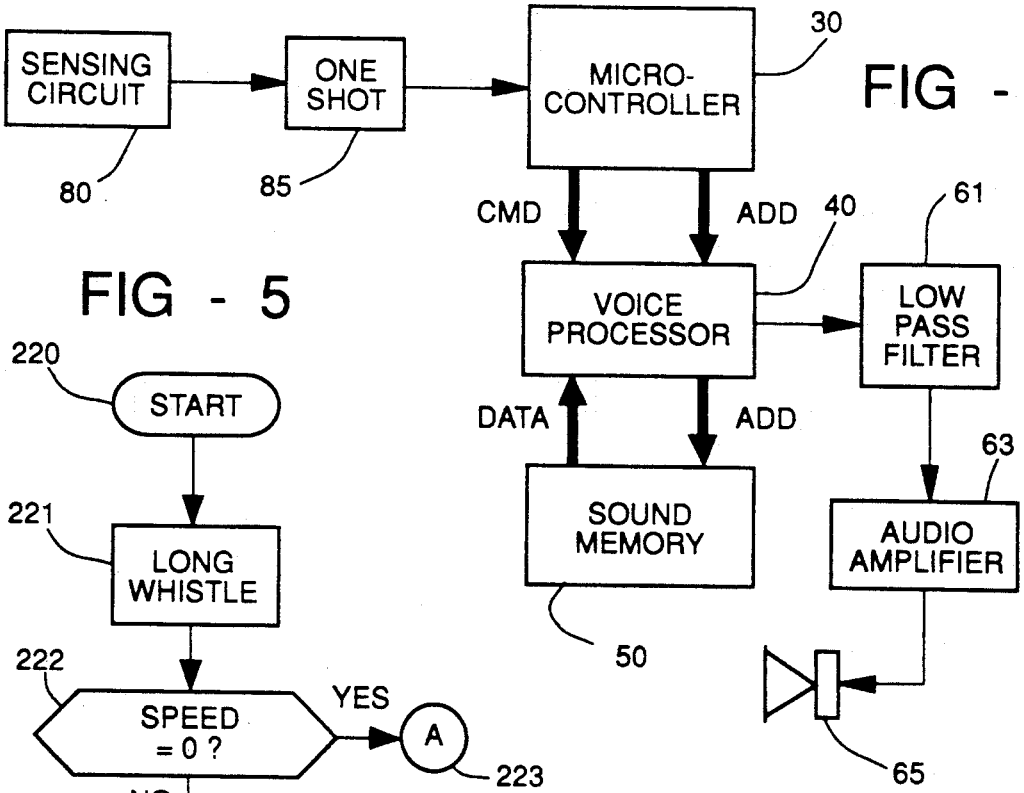
FIG - 9
FIG - 5
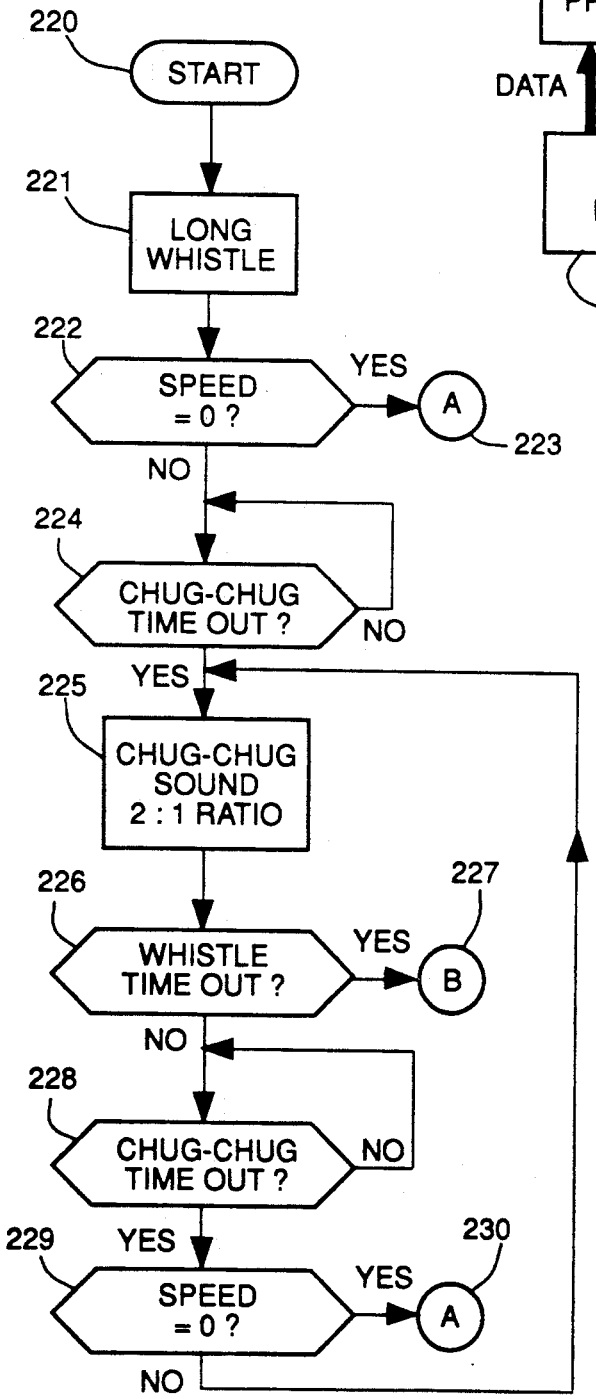
FIG - 10
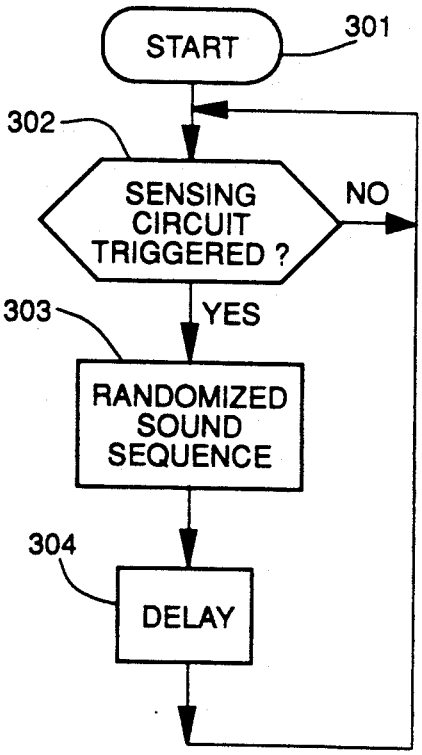

DIGITAL SOUND REPRODUCING SYSTEM FOR TOY TRAINS WITH STORED DIGITIZED SOUNDS RECALLED UPON TRACKSIDE TRIGGERING

TECHNICAL FIELD OF THE INVENTION

The technical field of this invention is that of digitally reproduced sound, and in particular, that of digitally reproduced sound adapted for producing realistic train sounds in a model train.

BACKGROUND OF THE INVENTION

A need exists for a realistic sound reproduction system for model trains. This need will be best fulfilled via a fully self-contained sound reproduction system which is mounted on the model train or other related structures.

SUMMARY OF THE INVENTION

The present invention is a digital sound reproduction system, which is useful in a model railroad system. In the preferred embodiment of the present invention, the digital sound reproducing system includes one or more sensors for triggering the production of sound. In particular, in accordance with the present invention, markers can be placed upon the track of the model railroad in order to mark the locations at which the model train is to produce one or more predetermined sound sequences. These sound sequences may include a train whistle, bell, diesel horn, railroad crossing bell, rail noise, station noises and voices, the steam chug-chug and train brakes. The digital sound reproducing system of the present application preferably assembles combinations of such sounds from digitally stored data in order to provide a realistic simulation of the sound of train operation.

In accordance with a further aspect of the present invention, at least some portion of the reproduced sound corresponds to train speed. In particular, in one embodiment of the present invention, a simulation of the steam piston noise of a steam train is reproduced at intervals related to the model train speed. In accordance with the preferred embodiment, the model train speed is detected employing a combination light emitting diode photo transistor which illuminates a spot on an axle of the car carrying the digital sound reproducing system. This portion of the axle has a reflective portion, such as a reflective tape, mounted thereon. This reflective tape causes the generation of a periodic light signal at a rate corresponding to the rotational rate of the car axle. Further, in order to take into the account the difference in wheel diameter between the wheel upon which the sensor is mounted and the driving wheel in the engine of the train, the steam chug sound is produced only once each two light pulses.

BRIEF DESCRIPTION OF THE DRAWINGS

These and other objects and aspects of the present invention will become clear from the following description of the invention, in which:

FIG. 1 illustrates in block diagram form the preferred embodiment of the present invention;

FIG. 2 illustrates in schematic diagram form the power supply employed to power the digital reproducing system of the preferred embodiment of the present invention;

FIGS. 3 to 8 illustrate in flow chart form the operation of the microcontroller illustrated in FIG. 1;

FIG. 9 illustrates in block diagram form an alternative embodiment of the present application; and FIG. 10 illustrates in flow chart form the operation of the microcontroller illustrated in the alternative embodiment of FIG. 10.

DETAILED DESCRIPTION OF THE PREFERRED EMBODIMENTS

Figure 3:
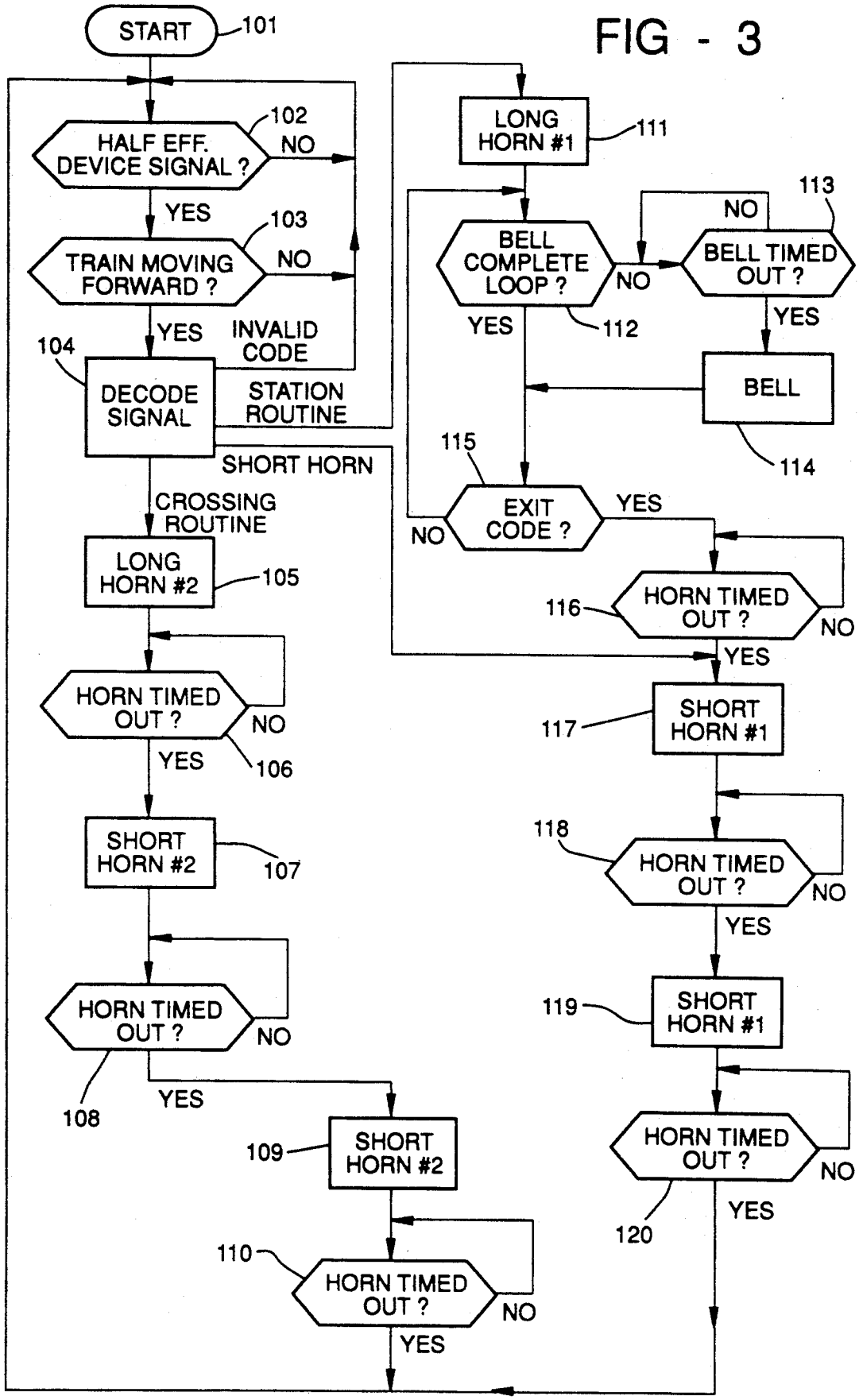

FIG. 1 illustrates in block diagram form the preferred embodiment of the present invention in which the digital sound reproducing system is disposed in a car of a model train. The digital sound reproducing system includes: Hall effect device 10; one shot circuit 15; light emitting diode photo transistor combination circuit 20; one shot circuit 25; microcontroller 30; voice processor 40; digital sound memory 50; low pass filter 61; audio amplifier 63; and loudspeaker 65.

Microcontroller 30 controls voice processor 40 in accordance with signals received from Hall effect device 10 and light emitting diode photo transistor combination circuit 20, causing recall of particular portions of digitized sound effects stored in digital sound memory 50. Voice processor 40 combines these recalled digitized sound effects and converts them into analog signals which are supplied to the analog audio system including low pass filter 61, audio amplifier 63 and speaker 65. In a manner which will be more fully described below, Hall effect device 10 detects the presence of one or more magnets 9 located between the ties of the track. Microcontroller 30 detects the number of each cluster of magnets 9 to determine the particular sound sequence to initiate. Light emitting diode photo transistor combination circuit 20 is employed to detect the speed of operation of the model train. Wheel 5 located on rail 1 of the model railroad system includes a reflective portion 7 mounted on its axle. The reflective portion 7 periodically reflects light from the light emitting diodes to the photo transistor, thereby permitting detection of one rotation of the axle of wheel 5. One shot circuits 15 and 25 are employed to regularize the pulse durations for detection by microcontroller 30.

In accordance with the preferred embodiment of the present invention, the digital sound reproducing apparatus is constructed of the following parts. Hall effect device 10 is Sprague part No. UGS-3040T. Light emitting diode photo transistor combination circuit 20 is a Honeywell part No. HOA1404-2. One shot circuits 15 and 25 are embodied in a dual one shot circuit part No. 74123. Microcontroller 30 is preferably a Motorola part No. 68HC05. Voice processor 40 is preferably an Okidata part No. MSM6295. Digital sound memory 50 is preferably of a capacity of at least 256 kilobytes. In accordance with the preferred embodiment of the present invention, digital sound memory 50 is embodied in electrically programmable read only memory. Low pass filter 61 is preferably embodied in a National part No. MF4. Low pass filter 61 preferably includes discrete components forming a low pass filter having a cut-off frequency of approximately 3.5 kilohertz. This low pass filter smoothes the transitions and the digital-to-analog process performed by voice processor 40 when generating the analog audio signal. Audio amplifier 63 is preferably embodied as a National part No. LM386N.

FIG. 2 illustrates the preferred embodiment of the power supply used to power the digital sound reproducing apparatus when employed in a toy train. In accordance with the known art, the model train is driven by electrifying the respective rails 1 and 3. It is known in the art that the polarity of electrification of rails 1 and 3 controls whether the model train travels forward or backward. In addition, the voltage applied across rails 1 and 3 controls the speed of operation of the train. In the present application, power supply pick-ups 71 and 72 contact the respective rails 1 and 3. Power supply pick-ups 71 and 72 are connected to the input terminals of a full wave bridge rectifier 73. The negative output terminal of full wave bridge rectifier 73 is connected to ground. The positive output terminal of full wave bridge rectifier 73 provides electric power for driving the sound reproducing apparatus. Power supply 70 preferably includes a rechargeable battery 76, which is connected to the positive output of full wave bridge rectifier via resistor 74. A 1N4737A zener diode 75 provides over-voltage protection for rechargeable battery 76. A regulated power supply 77 provides the required 5-volt DC electrical power used by the digital sound reproducing system. In the event that the voltage applied across rails 1 and 3 is great enough to operate regulated power supply 77, then the power to operate the digital sound reproducing system is derived from the rails. On the other hand, if the voltage across the rails decreases below this threshold, such as if the model train is moving slowly, then power for operation of the digital sound reproducing system is obtained from rechargeable battery 76. In the event that the voltage between rails 1 and 3 is greater than necessary for operating the regulated power supply, additional electric power is available to maintain charge in rechargeable battery 76. It is anticipated that in many cases the electric power derived from rails 1 and 3 will be sufficient to maintain rechargeable battery 76 fully charged throughout the operation cycle of the model train. In the event that rechargeable battery 76 becomes discharged, it may be recharged via power connector 78. Electric power from power connector 78 is coupled via diode 79 to resistor 74, in the same manner as electric power from full wave bridge rectifier 73. In this fashion, rechargeable battery 76 may be charged without removing it from the circuit.

The operation of the digital sound reproducing system of the present invention will now be described in conjunction with flow charts controlling the operation of microcontroller 30. In accordance with the known art, microcontroller 30 includes a program permanently stored in read only memory or electrically programmable read only memory which controls its operation. Microcontroller 30 is responsive to inputs from one shot circuits 15 and 25 and provides command and address signals to voice processor 40. Under this control, voice processor 40 recalls sound data from sound memory 50, in accordance with the received command and addresses. Once begun, voice processor 40 can be used to recall sound data from sound memory 50 throughout a range of addresses specified by microcontroller 30 until this range of addresses is complete. Upon recall of this sound data, it is converted into an analog audio signal which is supplied to the audio portion of the apparatus. The Okidata voice processor selected to embody the present invention has the additional capability of providing four separate channels of data which are mixed into the analog audio output. This means that particular sounds stored at different locations within sound memory 50 may be combined in a desired manner by proper commands from microcontroller 30 to voice processor 40.

In accordance with the preferred embodiment of the present invention as employed in a model train, the digital sound reproducing system emulates either a diesel train or a steam train. FIG. 3 illustrates the operation of the digital sound reproducing system in emulation of a diesel train. FIGS. 4 to 8 illustrate the operation of the digital sound reproducing system when emulating a steam train.

The program for control of microcontroller 30 for emulation of a diesel train is illustrated in FIG. 3. It should be noted that when emulating a diesel train it is not necessary to detect the speed of the train. Therefore, light emitting diode photo transistor combination circuit and one shot circuit 25 are not required in this embodiment. These circuits are only employed in the emulation of a steam train. The diesel program is begun via start block 101, which may include test routines executed upon initial powering of the digital sound reproducing apparatus. Microcontroller 30 first tests to determine when a signal has been received from the Hall effect device (this is in block 102) and whether or not the train is moving forward (this is in block 103). In the event that either of these tests fail, the program returns to the beginning of the loop to repeat these tests. Only if a signal has been received from the Hall effect device and the train is moving forward, is the signal received by the Hall effect device regarded as a valid signal. In accordance with the preferred embodiment of the present invention, differing sound sequences are produced by the digital sound reproducing apparatus in accordance with differing numbers of magnets 9. Microcontroller 30 decodes the signal received by the Hall effect device (processing block 104) to determine the received code. In the preferred embodiment of the present invention, the first magnet is employed to alert the system to the presence of a particular portion of the track marked by magnets 9. Thereafter, microcontroller 30 counts the number of following magnets to determine the particular code received and therefore the particular sequence of sounds to be produced at that location. If an invalid code is detected, then the test loop is repeated. Valid decoding signals corresponding to a crossing routine, a station routine and a short horn routine.

In the event that microcontroller 30 has detected magnets 9 corresponding to a crossing routine, then a long horn sound is begun (processing block 105). This is begun by microcontroller 30 sending commands and addresses to voice processor 40 which recall the particular sound corresponding to this long horn from sound memory 50. Microcontroller 30 then waits until the time required for production of this horn sound has expired (decision block 106). Note that because voice processor 40 operates independently of microcontroller 30. Microcontroller 30 has no manner of detecting the particular sounds being produced by voice processor 40. However, the particular address range and the particular command sent to voice processor 40 determines the length of the sounds to be reproduced. Once the long horn sound has been complete, then microcontroller 30 enables two blasts of a short horn (processing block 107, decision block 108, processing block 109, and decision block 110). These short horn sounds are recalled and reproduced in the same manner as the long horn sound. Once the long horn and two short horns have been sounded, then control returns to decision block 102 to repeat the test for receipt of the Hall effect device signal.

The station routine involves production of one long horn and simultaneous bells followed by two short horn blasts. If the station routine is decoded by decode signal block 104, then long horn 1 is begun (processing block 111). Microcontroller 30 next tests to determine whether the bell loop is complete (decision block 112). If this bell loop is not complete, then microcontroller 30 tests to determine whether a particular bell has timed out (decision block 113). If a bell has timed out, then a new bell is begun (processing block 114). This is done by causing voice processor 40 to recall from sound memory 50 digital sound data corresponding to the bell. Once the bell is complete, microcontroller 30 tests to determine whether an exit code has been received (decision block 115). In the preferred embodiment an additional magnet is placed at the station exit. Detection of this additional magnet via Hall effect device 10 indicates that the train has exited the station. This advances the station routine to the short horn routine. Microcontroller 30 remains in this loop with voice processor 40 sounding the long horn and repeatedly sounding the bell until the exit code is received. During this interval, the horn is being continuously sounded and the bell is being repeatedly sounded. Thereafter, microcontroller 30 tests to determine if the long horn has timed out (decision block 116). Microcontroller 30 waits until the long horn has timed out and then branches to the short horn routine.

The short horn routine is reached either at the end of the station routine or if magnets 9 encountered at a particular location decodes to a short horn routine. Firstly, short horn number 1 is sounded (processing block 117) and microcontroller 30 waits until this horn has timed out (decision block 118). Thereafter short horn number 1 is sounded again (processing block 119) and microcontroller 30 waits until this horn has timed out (decision block 120). Once this has occurred, the short horn routine is complete and control returns to decision block 102 to await the next Hall effect device signal.

Figure 4:
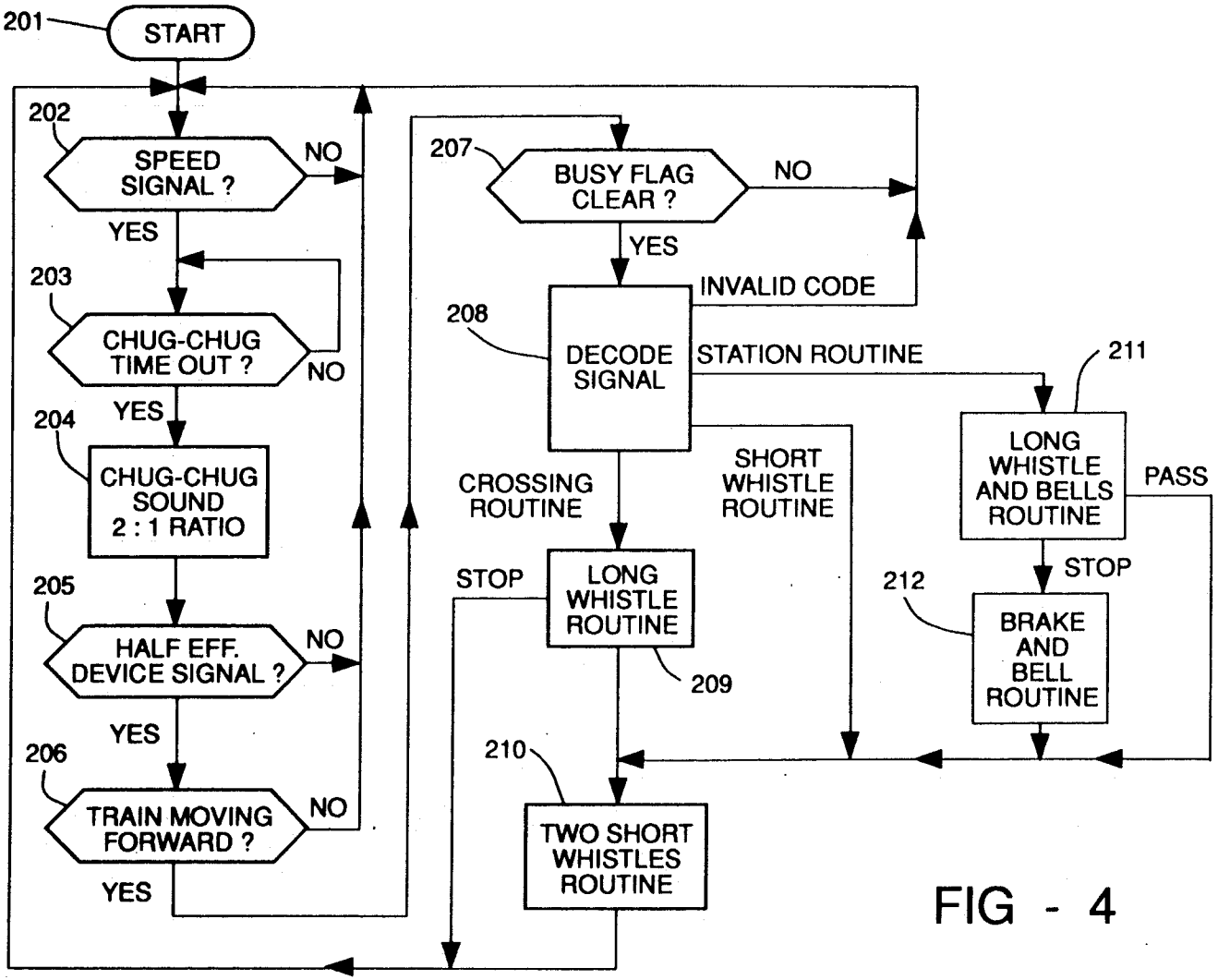
Figure 6:
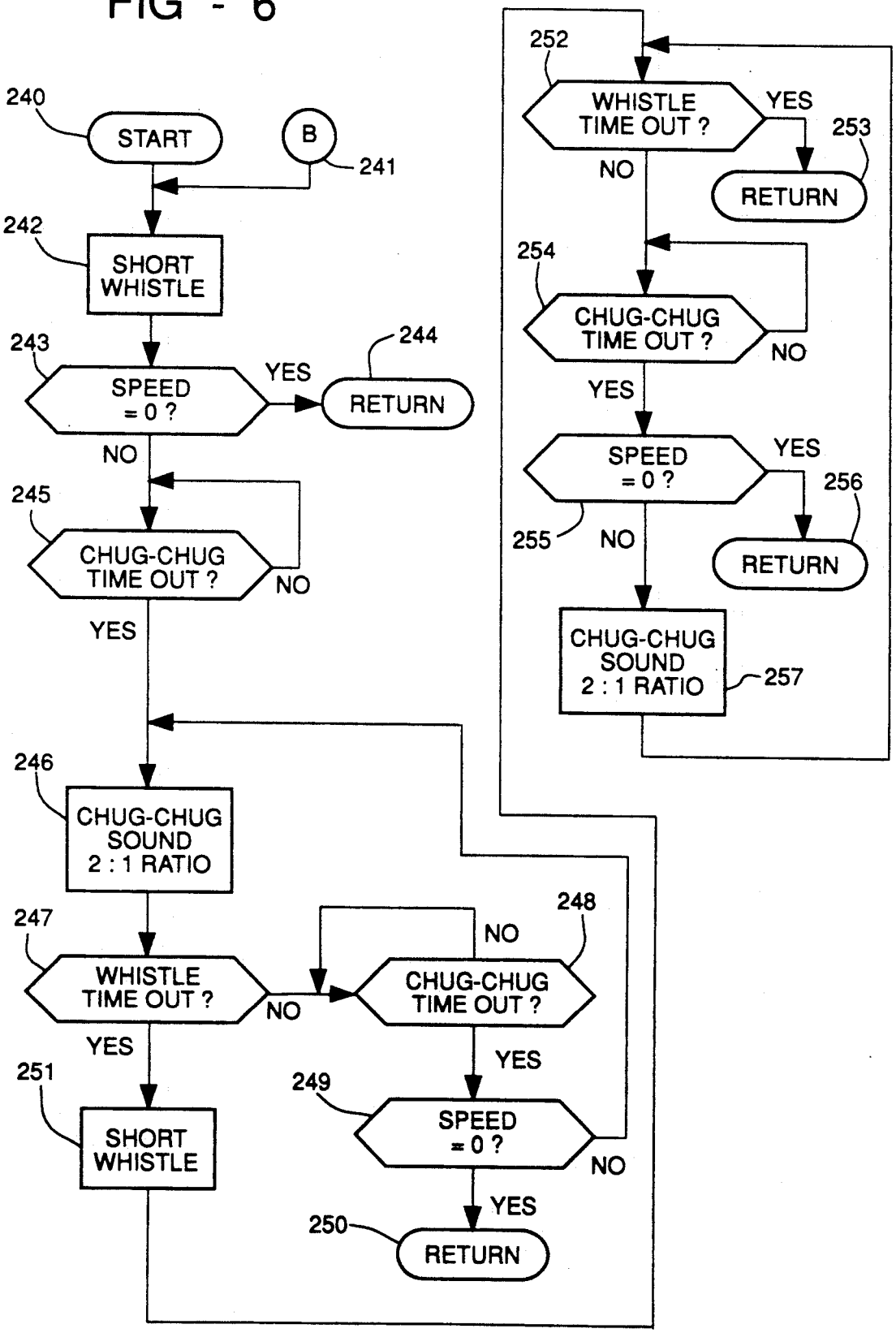
Figure 7:
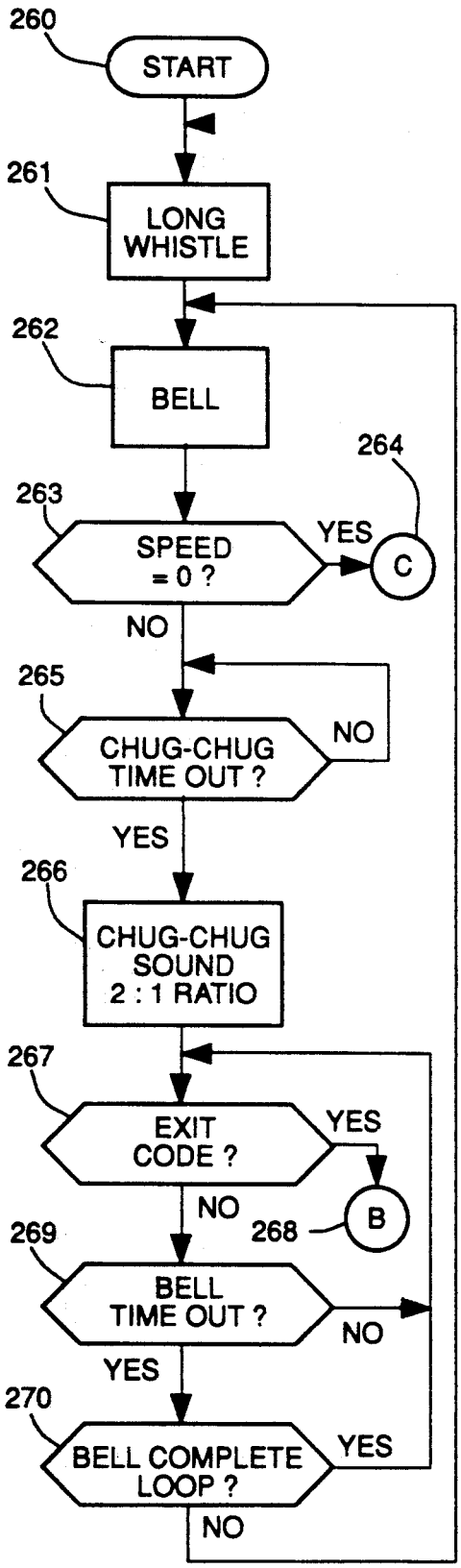
Figure 8:
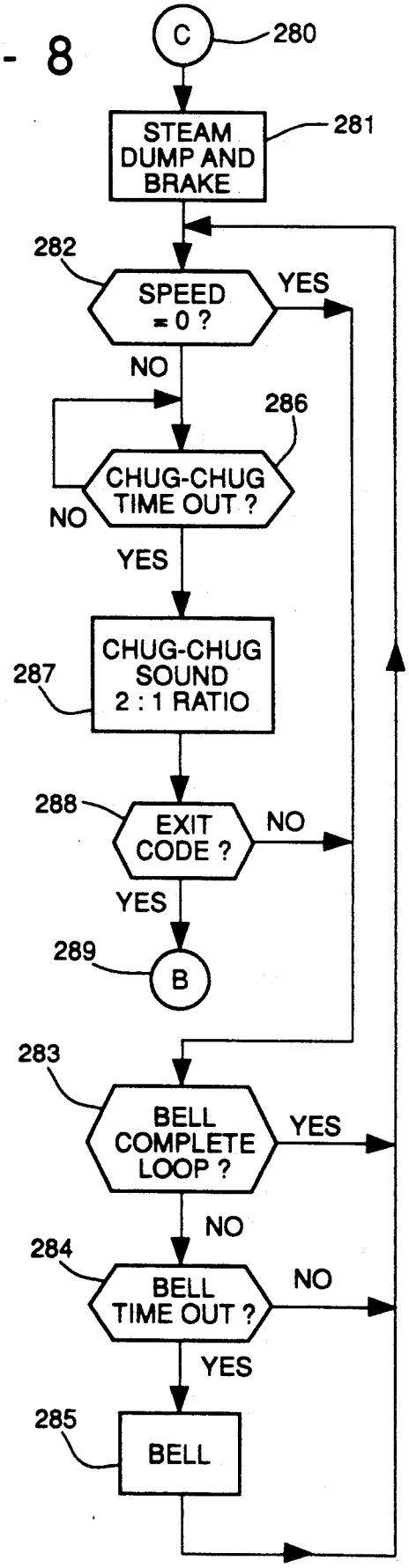

The process by which the digital sound reproducing system emulates a steam train is more complex than the emulation of a diesel train. This process is illustrated in the flow charts of FIGS. 4 to 8. FIG. 4 illustrates the general outlines of this process. FIG. 5 illustrates the operation of the long whistle routine. FIG. 6 illustrates the operation of the short whistle routine. FIG. 7 illustrates the operation of the long whistle and bells routine. Lastly, FIG. 8 illustrates the operation of the brake and bell routine when the model train is stopped at a station.

The emulation of the steam train begins at start block 201, which is similar to start block 101 illustrated in FIG. 3. Microcontroller 30 tests to determine whether or not a speed signal has been received (decision block 202). Microcontroller 30 continues to make this test until such a speed signal has been received. Microcontroller 30 next tests to determine whether a chug-chug time out has occurred (decision block 203). If this is not the case, microcontroller 30 waits until this has occurred and then proceeds to produce the chug-chug sound in the two to one ratio (processing block 204). As previously described, the chug-chug sound corresponding to the operation of a steam piston is sounded once every other axle rotation signal. This takes into account the difference in wheel diameter between the wheel mounted in the car including the sound reproducing system and the driving wheel of the engine.

Microcontroller 30 next tests to determine whether the Hall effect device signal has been received (decision block 205) and whether or not the train is moving forward (decision block 206). If either of these tests fail, then control returns to decision block 202 to wait for the next speed signal. If a Hall effect signal has been received and the train is moving forward, then the microcontroller 30 tests to determine if the busy flag is clear (decision block 207). This busy flag indicates whether a previous sound has timed out. If no previous sounds are pending, then number of magnets 9 at the particular location is decoded to determine what sounds to reproduce (processing block 208). If an invalid code has been received, then control returns to decision block 202 to await the next speed signal.

If a crossing routine has been decoded, then microcontroller 30 begins a long whistle routine (processing block 209). There are two exits from this long whistle routine. If the speed of the train is reduced to zero by the interval between speed signals exceeding a predetermined amount, then the train is stopped. In this event, control returns to decision block 202 to await the next speed signal. If, on the other hand, the long whistle sound is completed, then microcontroller 30 executes a two short whistles routine (processing block 210). One of the valid codes detected by the code signal processing block 210 is execution of a short whistle routine. In this event, control passes directly from the code signal processing block 208 to the two short whistles routine block 210. In the event that a station routine is decoded by decode signal block 208 then a long whistle and bells routine is begun (processing block 211). There are two exits from the long whistle and bells routine 211. If the model train has stopped then the brake and bell routine 212 is executed. If, on the other hand, the train does not stop during the long whistle and bells routine the microcontroller 30 passes to the two short whistles routine 210. As will be fully described below, microprocessing 30 remains within the brake and bell routine 212 until the train again moves, thereafter microcontroller 30 passes to the two short whistles routine 210.

FIG. 5 illustrates the long whistle routine 209 which is the beginning of the crossing routine. Long whistle routine is begun via start block 220. Microcontroller 30 first begins a long whistle sound (processing block 221). Microcontroller 30 then tests to determine whether the speed of the model train is zero (decision block 222). This determination is made by detection of the length of time between consecutive speed signals. If this time exceeds a predetermined amount, then the speed is understood to be zero. If the speed is zero then long whistle routine 209 is exited via exit 223. This exit corresponds to the stop exit illustrated in FIG. 4 and returns microcontroller 30 to decision block 202. Thus the sequence of sounds in the crossing routine is aborted if the model train stops.

Microcontroller 30 next tests to determine whether or not the chug-chug time out has occurred (decision block 224). In accordance with the present invention the length of time for production of the steam piston sound must pass to produce a chug-chug time out. Once this has occurred then microcontroller 30 sounds the chug-chug using the two to one ratio (processing block 225). This occurs in the same manner as previously described. Upon completion of chug-chug subroutine 225 microcontroller 30 tests to determine whether a whistle time out has occurred (decision block 226). If this is the case then a normal exit of the long whistle routine is achieved. Long whistle routine 209 is exited via exit box 227 which transfers control to the beginning of the two short whistles routine 210. If the whistle time out has not occurred then microcontroller 30 waits for a chug-chug time out (decision block 228). Once this has occurred microcontroller 30 tests to determine whether the speed is zero (decision block 229). If this is the case then long whistle routine 209 is exited via exit box 230, transferring control to decision block 202. Microcontroller 30 remains in this loop until either the whistle time out occurs or the speed equals zero.

FIG. 6 illustrates the two short whistles routine 210. The two short whistles routine 210 may be entered normally via start block 240 directly from decode signal processing block 210 or may be entered via entry block 241 from either the long whistle routine 209, the long whistle and bells routine 211 or the brake and bell routine 212. The two short whistles routine 210 begins by sounding a short whistle (processing block 242). The two short whistles routine 210 next tests to determine whether the speed equals zero (decision block 243). If this is the case then the two short whistles routine 210 is aborted via return block 244. If this is not the case, then microcontroller 30 waits for a chug-chug time out (decision block 245). After the chug-chug time out has occurred microcontroller 30 produces the chug-chug sound on the two to one ratio (processing block 246). Microcontroller 30 then tests to determine whether a whistle time out has occurred (decision block 247). If this is the case then microcontroller 30 waits for a chug-chug time out (decision block 248). Once this time out has occurred microcontroller 30 tests to determine whether the speed is zero (decision block 249). If the speed is not zero then microcontroller 30 again produces the chug-chug sound (processing block 246). If, on the other hand, the speed is zero then the two short whistles routine 210 is aborted via return block 250. Microcontroller 30 remains in this loop until either a whistle time out has occurred (decision block 247) or the speed equals zero (decision block 249).

In the event that the whistle time out has occurred, then microcontroller 30 again commands voice processor 40 to sound the short whistle (processing block 251). Microcontroller 30 then tests to determine whether or not a whistle time out has occurred (decision block 252). If this is the case, then the two short whistles routine 210 is complete and is exited via return block 253. If a whistle time out has not occurred then microcontroller 30 waits for expiration of the chug-chug time out (decision block 254). Upon expiration of the chug-chug time out, microcontroller 30 tests if the speed is zero (decision block 255). If the speed is zero then the two short whistles routine 210 is aborted via return block 256. If the speed is not zero, then microcontroller 30 produces the chug-chug sound (processing block 257). Microcontroller 30 remains in this loop until either the whistle time out occurs (decision block 252) or the speed equals zero (decision block 255).

FIG. 7 illustrates the long whistle and bells routine 211. Long whistle and bells routine 211 is begun by a start block 260. Microcontroller 30 first causes voice processor 40 to recall and reproduce the long whistle (decision block 261) followed by a bell (processing block 262). Microcontroller 30 then tests to determine if the speed equals zero (decision block 263). If the speed does equal zero then long whistle and bells routine 211 is exited via exit block 264. This corresponds to the stop exit illustrated in FIG. 4 and leads to the beginning of the brake and bell routine 212. In the case that the speed is not zero microcontroller 30 waits for a chug-chug time out (decision block 265). Upon expiration of the chug-chug time, microcontroller 30 produces the chug-chug sound (processing block 266). Microcontroller 30 then tests for an exit code (decision block 267). This exit code is an additional magnet located in the track marking the station exit. If this exit code is detected then long whistle and bells routine 211 is exited normally via exit block 268. This transfers control to the beginning of the two short whistles routine 210. In the event that this exit code is not detected then microcontroller 30 tests for a bell time out (decision block 269). If this bell time out is not received then microcontroller 30 returns to decision block 267 to determine whether the exit code is received. If this bell time out is received then microcomputer 30 tests to determine if the bell loop is complete (decision block 270). If the bell loop is not complete, the bell is again sounded at processing block 262. If the bell loop is complete, the microprocessor 30 returns to test if the exit code is received (decision block 267). Microcontroller 30 remains in this loop until either the exit code is received, whereupon the long whistle and bells routine is exited normally, or the bell time out is received. In the event that the bell time out is received microcontroller 30 returns to processing block 262 to repeat sounding of the bell and to begin this loop anew. Thus the beginning of the station routine includes a long whistle and plural bells.

FIG. 8 illustrates the brake and bells routine. Brake and bells routine 212 is entered by entry block 280 from the stop exit of long whistle and bells routine 211. Microcontroller 30 first sounds the steam dump and brake sounds by proper activation of voice processor 40 (processing block 281). This corresponds to the sound a steam engine would make when braking at the station. Microcontroller 30 then tests to determine whether the speed is zero (decision block 282). If the speed is still zero, microcontroller 30 tests to determine whether a complete bell loop has been made (decision block 283) and whether or not a bell time out has occurred (decision block 284). In the event that a complete bell loop has not been made and a bell time out has been received then microcontroller 30 causes voice processor 40 to generate the bell sound (processing block 285). In all other cases control returns to decision block 282 to test the speed. Microcontroller 30 remains in this loop, repeatedly sounding the bell until the speed is no longer equal to zero.

Once the train is moving again, that is once decision block 282 determines the speed is no longer zero, microcontroller 30 waits for a chug-chug time out (decision block 286) and thereafter produces the chug-chug sound (processing block 287). This serves to automatically generate the sound of the steam piston when the train begins motion after being stopped at the station. Microcontroller 30 then tests for an exit code (decision block 288). This exit code is an additional track magnet marking the station exit. If the exit code is not yet received, then control returns to decision block 283 to complete the bell operation. Once the exit code has been received then brake and bells routine 212 is exited via exit block 289. This passes control to two short whistles routine at 210.

Those skilled in the art would realize that there are a number of alternative mechanisms for triggering the sound production process. Although the above description of the invention employs magnets located in the track and a Hall effect sensor, other techniques for indicating locations for sound production are possible. In addition, sound production could be triggered via a operator initiated modulated command signal. Replacement of Hall effect sensor 10 with an appropriate receiver could permit receipt of such a modulated command signal via visible or infrared light, ultrasonic sound, radio waves or via a modulated signal on electrified rails 1 and 3. Further, the digital sound reproducing system could be located in a fixed structure near the model train track. Replacement of Hall effect device 10 and light emitting diode photo transistor combination circuit 20 with a visible or infrared light or ultrasonic sound proximity sensor for the model train would enable production of sounds corresponding to the location of the model train. Alternately, such a fixed digital sound reproducing system could be triggered by modulated command signals via wires, visible or infrared light, ultrasonic sound, radio waves or via a modulated signal on electrified rails 1 and 3. The essential feature is that a triggering signal causes the production of a corresponding sound.

FIGS. 9 and 10 illustrate an alternative embodiment of the digital sound reproducing apparatus of the present invention which may be used in a office or home for production of a sequence of background noises in response to a preselected input. The construction of the apparatus is illustrated in block diagram form in FIG. 9. FIG. 9 is similar to the apparatus illustrated in FIG. 1 except for sensing circuit 80 and one shot circuit 85 which are connected to microcontroller 30. In accordance with the preferred embodiment of the present invention, sensing circuit 80 is operative to detect the presence of a person within the room containing the digital sound reproducing apparatus. This may be, without limitation, an ultrasonic motion sensor, a heat sensor, a sound detector or a light detector. In addition, the apparatus of FIG. 9 may be actuated by a simple on/off switch.

FIG. 10 illustrates the operation of microcontroller 30 in the alternative embodiment of FIG. 9. Microcontroller 30 begins via start block 301 which is similar to start blocks 101 and 201 previously illustrated. Microcontroller 30 tests to determine whether the sensing circuit is triggered (processing block 302). This test is repeated until satisfied. Microcontroller 30 then begins the sound sequence. In the preferred embodiment this is some type of randomly selected repetitive sound suitable for background sound in an office or home. These sounds may include without limitation, raindrops, storms, surf, fans, bubbling fountains, wind noise or birdsong. Microcontroller 30 then delays for a time approximating the length of time of the randomized sound sequence (processing block 304). Control then returns to decision block 302 to repeat the sensor test. This causes the randomized sound sequence to be continuously repeated while the sensor is triggered. By employing a randomly selected sound sequence each loop of the background sound can be repeated continuously without appearing to be repetitive.

We claim:

1. A digital sound reproducing system for a model train traveling on a track comprising:

a digital sound memory storing, at predetermined addresses, a plurality of digitized sound effects;

a trigger sensor for producing a coded trigger signal upon detection of a predetermined condition corresponding to a particular location of the track when the car passes each of a plurality of locations of the track;

a controlled connected to said digital sound memory and said trigger sensor for recalling from said digital sound memory one of a plurality of differing predetermined sequences of said digitized sound effects upon each generation of said coded trigger signal; and a sound reproducing means connected to said digital sound memory and said controller for audibly reproducing sound corresponding to said predetermined sequence of digitized sound effects recalled from said digital sound memory;

said digital sound memory, said trigger sensor, said controller and said sound reproducing means all being disposed in a car of the model train.

2. The digital sound reproducing system for a model train claimed in claim 1, wherein the model train further includes a pair of electrified rails for powering the model train, said digital sound reproducing system further comprising:

an electric power supply disposed in said car of the model train including a pair of power pick-ups, one electrically coupled to each of the electrified rails, a full wave rectifier circuit having a first pair of terminals coupled to said pair of power pick-ups and a second pair of terminals producing unidirectional DC power regardless of the polarity of electricity of the pair of electrified rails, a rechargeable battery coupled to said second pair of terminals of said full wave rectifier, and a regulating power supply connected to said full wave rectifier and said rechargeable battery for powering said digital sound reproducing system, whereby said rechargeable battery is recharged by electric power from the pair of electrified rails and electric power is available to said digital sound reproducing system from said rechargeable battery regardless of the voltage of the pair of electrified rails.

3. The digital sound reproducing system for a model train claimed in claim 2, wherein:

said electric power supply further includes a first power supply coupler connected to said rechargeable battery, and an external source of unidirectional DC power of the same polarity as produced by said second pair of terminals of said full wave rectifier connected to a second power supply coupler mating with said first power supply coupler, whereby externally produced electric power may be supplied via said first and second power supply couplers to recharge said rechargeable battery.

4. The digital sound reproducing system for a model train claimed in claim 3, wherein:

said trigger sensor generates a crossing coded trigger signal when the car passes a first location of the track corresponding to a road crossing and generates a station coded trigger signal when the car passes a second location of the track corresponding to a station; and said controller recalls from said digital sound memory a first predetermined sequence of said digitized sound effects including at least a horn upon generation of said crossing coded trigger signal, and a second predetermined sequence of said digitized sound effects including at least a bell upon generation of said station coded trigger signal.

5. The digital sound reproducing system for a model train claimed in claim 3, wherein:

said trigger sensor generates a crossing coded trigger signal when the car passes a first location of the track corresponding to a road crossing and generates a station coded trigger signal when the car passes a second location of the track corresponding to a station; and said controller recalls from said digital sound memory a first predetermined sequence of said digitized sound effects including at least a whistle upon generation of said crossing coded trigger signal, and a second predetermined sequence of said digitized sound effects including at least a bell upon generation of said station coded trigger signal.

6. The digital sound reproducing system for a model train claimed in claim 1, wherein:

said trigger sensor includes means for generating a corresponding coded trigger signal when the car passes at least one predetermined marker disposed along the track.

7. The digital sound reproducing system for a model train claimed in claim 6, wherein:

said trigger sensor includes a magnetic sensor; and said predetermined markers consist of magnets disposed along the track.

8. The digital sound reproducing system for a model train claimed in claim 7, wherein:

said trigger sensor includes a Hall effect device.

9. The digital sound reproducing system for a model train claimed in claim 6, wherein:

said trigger sensor produces said corresponding coded trigger signal based upon the number of said predetermined markers disposed within a predetermined distance along the track.

10. The digital sound reproducing system for a model train claimed in claim 1, further comprising:

a model train speed sensor disposed in said car of the model train for detecting the model train speed; and wherein said plurality of digitized sound effects stored in said digital sound memory includes a speed related digitized sound effect;

said controller being further connected to said model train speed sensor and further including means for recalling from said digital sound memory a predetermined sequence of said digitized sound effects consisting of said speed regulated digitized sound effect at intervals proportional to said detected model train speed.

11. The digital sound reproducing system for a model train claimed in claim 10, wherein:

said model train speed sensor includes a reflector mounted on an axle of the car, and a combined illumination and detection means for illuminating the axle and generating a rotation signal upon detection of the passage of illumination reflected by said reflector; and said speed related digitized sound effect corresponds to a chug of a steam train piston;

said controller further including means for recalling from said digital sound memory said predetermined sequence consisting of said speed related digitized sound effect once for a predetermined number of said rotation signals.

12. The digital sound reproducing system for a model train claimed in claim 11, wherein:

said predetermined number of rotation signals is two.

13. The digital sound reproducing system for a model train claimed in claim 10, wherein:

said controller further includes means for recalling from said digital sound memory a predetermined sequence of speed related digitized sound effects corresponding to the application of train brakes when said detected model train speed falls below a predetermined model train speed.

14. A digital sound reproducing system for a model train travelling on a track, said digital sound reproducing system disposed in a car of the model train and comprising;

a location sensor for producing a corresponding coded location signal when the car passes each of a plurality of predetermined locations of the track;

a microcontroller connected to said location sensor for generating a predetermined sequence of sound commands upon each generation of said location signal, wherein said microcontroller generates one of a plurality of predetermined sequences of said sound commands corresponding to said coded location signals generated; and a digital sound memory storing at predetermined addresses a plurality of digitized sound effects;

a voice processor connected to said microcontroller for receiving said sound commands and to said digital sound memory for recalling said digitized sound effects stored in said digital sound memory from said addresses corresponding to said sound commands from said microcontroller, converting said recalled digitized sound effects into an analog audio signal upon each generation of said sound command by said microcontroller; and a sound reproducing means connected to said voice processor for audibly reproducing sound corresponding to said analog audio signal.

15. The digital sound reproducing system for a model train claimed in claim 14, wherein:

said location sensor includes a magnetic sensor for generating a detection signal upon each detection of a magnet disposed along the track; and said microcontroller generates one of a plurality of differing predetermined sequences of said sound commands corresponding to the number of said detection signals generated within a predetermined period of time.

16. The digital sound reproducing system for a model train claimed in claim 14, further comprising:

a model train speed sensor including a reflector mounted on an axle of the car, and a combined illumination and detection means for illuminating the axle and generating a rotation signal upon detection of the passage of illumination reflected by said reflector;

said microcontroller being further connected to said model train speed sensor and further including means for generating a chug sound command once for a predetermined number of said rotation signals; and said digitized sound effects stored in said digital sound memory includes a chug digitized sound effect corresponding to a chug of a steam train piston stored at said address corresponding to said chug sound command.

17. The digital sound reproducing system for a model train claimed in claim 14, further comprising:

a model train speed sensor including a reflector mounted on an axle of the car, and a combined illumination and detection means for illuminating the axle and generating a rotation signal upon detection of the passage of illumination reflected by said reflector;

said microcontroller being further connected to said model train speed sensor and further including means for generating a brake sound command when the time interval between generation of said rotation signals exceeds a predetermined time; and said digitized sound effects stored in said digital sound memory includes a brake digitized sound effect corresponding an application of train brakes stored at said address corresponding to said brake sound command.

* * * * *